US005158318A

United States Patent [19]

Dittmar

[11] Patent Number: 5,158,318

[45] Date of Patent: Oct. 27, 1992

[54] SNOW SKIS WITH MICROGROOVES

[76] Inventor: Edbert E. L. Dittmar, 1290 NW. Mall St., Issaquah, Wash. 98027

[21] Appl. No.: 332,938

[22] PCT Filed: Apr. 18, 1988

[86] PCT No.: PCT/US88/01201

§ 371 Date: Dec. 19, 1988

§ 102(e) Date: Dec. 19, 1988

[51] Int. Cl.[5] ..... A63C 5/048

[52] U.S. Cl. ..... 280/608

[58] Field of Search ..... 280/608, 607

[56] References Cited

U.S. PATENT DOCUMENTS

| | | | |
|---|---|---|---|
| 3,063,728 | 11/1962 | Patterson | 280/608 |
| 3,381,972 | 5/1968 | Miller | 280/608 |
| 4,175,766 | 11/1979 | Barwin | 280/608 |
| 4,722,543 | 2/1988 | Brugger | 280/609 |

FOREIGN PATENT DOCUMENTS

| | | | |
|---|---|---|---|
| 801817 | 7/1949 | Fed. Rep. of Germany | 280/609 |
| 2009434 | 9/1971 | Fed. Rep. of Germany | 280/608 |
| 2403944 | 8/1975 | Fed. Rep. of Germany | 280/608 |
| 2065825 | 5/1976 | Fed. Rep. of Germany | 280/608 |
| 771195 | 4/1934 | France | 280/608 |
| 494087 | 5/1954 | Italy | 280/609 |
| 586565 | 12/1958 | Italy | 280/608 |

*Primary Examiner*—David M. Mitchell

[57] ABSTRACT

A snow ski with one or more small grooves near the undersurface edges, with or without edge inserts typically found on the undersurface of snow skis. The grooves are designed to facilitate rapid and precise maneuvering through snow or ice surfaces. The grooves, formed parallel to the ski edge, are relatively short, nominally between 5 centimeters to 45 centimeters in length, to minimize any tendency for a ski with grooves to track in a straight line. They are typically located near the edge of the ski undersurface and longitudinally under the boot attachment position of the uppersurface. The grooves can be of various shapes designed to optimize the cutting affect of the groove as it complements the cutting of the sharp ski edge during turning maneuvers in the usual manner of skiing. The ski undersurface can be beveled at its side to reduce any increase in drag during straight skiing that may be caused by adding grooves to the undersurface.

2 Claims, 2 Drawing Sheets

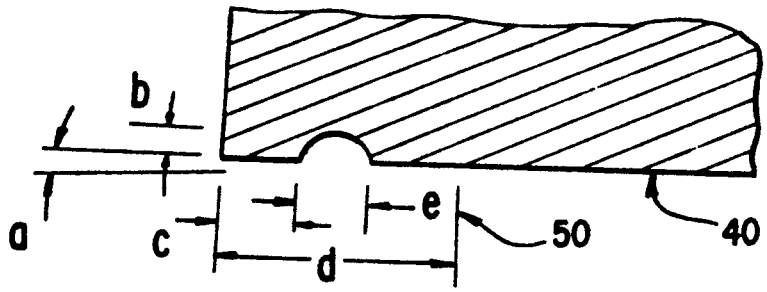
FIG.3
FIG.4
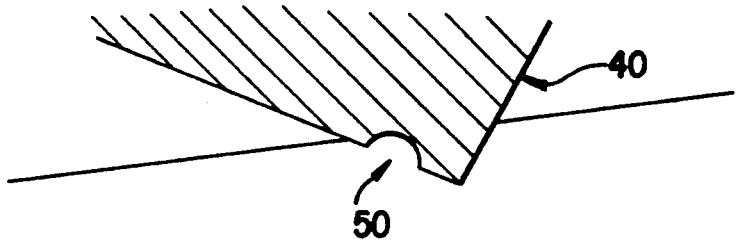

SNOW SKIS WITH MICROGROOVES

TECHNICAL FIELD

This invention relates to snow skis with small grooves near and adjacent the edge of the ski and under the longitudinal location of the boot attachment. The grooves on the bottom of the snow skis are useful for facilitating change in direction by cutting into the snow or ice, such cutting action being additional to the ski edges, thereby providing a better grip by the skis during turning in the usual manner of skiing. The grooves are necessarily limited in length such that the turning advantage is not offset by the tendency of a groove to track in a constant direction. The edge of the ski can also be beveled to minimize any increase in drag caused by the addition of the grooves.

BACKGROUND ART

Snow skis are intended to permit a skier to move rapidly and precisely down a snow-covered slope. Edge inserts are commonly built into the snow ski undersurface sides, typically made of metal although the inserts can be constructed of any other suitable material, or the ski can be constructed without edge inserts. The ski edges are typically sharp to penetrate severely compacted snow or ice.

Grooves on skis are known in the art, both for snow skis and for water skis. For example, U.S. Pat. Nos. 3,381,972, 3,395,411, 3,907,315, 4,585,249. However, none of these skis with grooves describe the art or provide the advantages of improved performance taught by this invention.

DISCLOSURE OF INVENTION

This invention provides important improvements over previous skis. The objective of this invention is to provide a snow ski that permits a skier to move rapidly and to precisely maneuver down a snow-covered slope. Typically, a snow ski is provided with sharp metal longitudinal edges that cut into snow or ice when a skier negotiates a turn in the normal manner of skiing. It is the objective of this invention to facilitate more precise control during turning by providing additional small, longitudinal cutting edges in the form of grooves of limited length located near the ski undersurface edge, generally located under the boot area of the ski. Where the ski is provided with ski edge inserts, the grooves are typically located in those inserts. The groove shape or shapes are designed to maximize performance requirements for the intended use. An added benefit is that, with sharp edges provided on grooves within the ski undersurface near the edge, the requirement for sharpness on the ski edge is reduced. Thus, edges can be fabricated with less than very sharp edges to reduce occurrence of lacerations to the skier, especially occurring with accidents, to prolong the use of skis otherwise requiring high performance sharp edges, or to extend the mean time between edge sharpening.

It is also the objective of this invention to provide increased turning control and ability while maintaining minimum drag on the ski undersurface and not increasing the tendency of a ski to maintain a straight track, both of which are typically caused when grooves are added to a ski undersurface. This objective is achieved both by providing a slight bevel on the undersurface ski edge and by limiting the length of the grooves to less than or equal to twenty percent of the length of the ski.

One skilled in the art will recognize the advantages taught by this invention and illustrated by the preferred embodiment presented. The specification and drawings are not intended to represent an exhaustive description of the invention. Obvious applications and extensions of the invention are intended to be within the spirit and scope of this invention.

BRIEF DESCRIPTION OF DRAWINGS

FIG. 3 shows representative dimensions of a groove 50 and its location in the ski edge insert 40.

FIG. 4 shows the qualitative advantage of providing a groove 50 in gripping the snow or ice as compared to a conventional ski without a groove.

BEST MODE OF CARRYING OUT THE INVENTION

This invention teaches a ski with grooves near a ski edge undersurface, in an edge insert if provided in the ski undersurface, the groove dimensions being typically between 0.5 millimeters and 2.0 millimeters in width, with a minimum depth of 0.1 millimeters, parallel and adjacent to the sharp ski edge. The insert is typically made of a metal material but can be similarly provided with any other suitable material. In the alternative, the ski may be constructed without a ski edge, in which case the grooves are located at nominally the same location on the ski undersurface with similar dimensions. The grooves are relatively short, nominally between 5 centimeters and 45 centimeters in length with a maximum length of nominally 20 percent of the ski length. The grooves are limited in length to facilitate turning as the grooves and ski edges cut into the snow and ice to effect a change in direction in the normal manner of skiiin. Skis with grooves longer than this length are useful for maintaining a constant direction ("track" or "rail") and increased stability, but they severely impede change in direction. Such skis with long grooves have been used for alpine and cross-country skiing but have not been effective for down-hill skiing.

Figure 1:
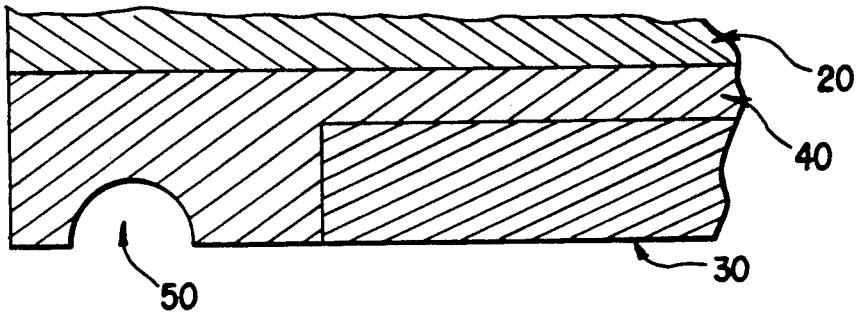
FIG. 1 shows an enlargement of a ski edge with insert 40, typically made of metal, showing the location of a groove 50 near the edge of the ski.

The position of the groove or grooves is usually directly under the boot attachment location. Grooves 50 are typically located in a ski edge insert 40, usually metal, which forms the undersurface edge of the ski 5, illustrated in FIG. 1. The grooves are parallel to the ski edge insert 40 and adjacent to the edge but not at the edge; a groove at the edge would prevent sharpening of the edge and hence reduce the useful lifetime of the ski. As shown in FIG. 3 the groove should be between 0.1 millimeter and 1.0 millimeter from the ski edge.

Figure 2:
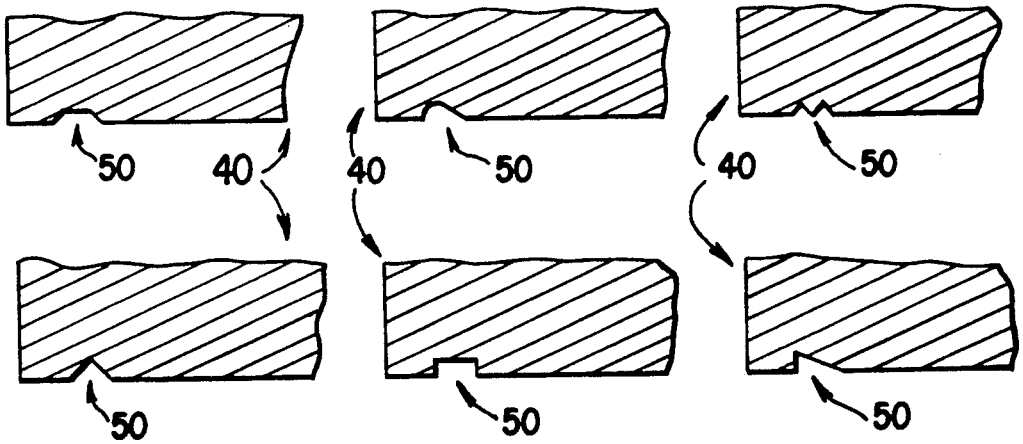
FIG. 2 shows various possible configurations of a groove, which groove may in fact consist of a set of several separate groves producing the desired effect.

Various configurations and combinations of grooves may be used. FIG. 2 shows several examples of groove configurations: a circular groove, two triangular grooves, a rectangular groove, and a "hook-shaped" groove. These sample grooves are illustrative only and not meant to represent all possible groove shapes included in or defining the scope of the invention.

To minimize any drag on the ski caused by the small groove or grooves, the ski edge insert, or the ski undersurface near the edge, can be beveled slightly. As shown in FIG. 3, the bevel should be approximately 1 or 2 degrees, extending from the edge approximately 3.0 millimeters.

Each groove is small, typically between 0.5 millimeters and 2.0 millimeters in width, with a minimum depth of 0.1 millimeters. The length of a groove is typically between 5 centimeters and 45 centimeters and located at the center of gravity of the ski, usually under the boot area of the ski. The actual length and width of the groove will vary depending on the physical characteristics and preferences of the skier. A large, or heavy skier will probably prefer a slightly longer groove compared to a light-weight skier. The groove, however, would generally not exceed 20 percent of the total ski length. The shape and dimensions of a groove and the number and combination of groove shapes alters the characteristics of the ski, and therefore will be selected by the skier to achieve the individual performance desired.

INDUSTRIAL APPLICATION

The invention described herein has application to recreational and professional snow skiiing.

Having described the invention, what is claimed is:

1. In a ski for use on ice and snow having an upper surface and an under surface, the upper surface having a binding for receiving a ski boot intermediate the length of the ski and the under surface comprising narrow hard metal strips running substantially the entire length of the ski and along the edges thereof and a plastic surface therebetween, the improvement comprising a groove in one or more of the metal strips and positioned at the under surface opposite the binding and parallel to and located between 0.1 millimeters to 1.0 millimeters from the ski edge, the length of the groove extending between 5 centimeters and 45 centimeters with a maximum length of nominally 20 percent of the length of the ski and having small cross-sectional dimensions whereby the groove provides resistance to lateral slippage without adversely increasing tracking on snow or ice.

2. A ski as in claim 1 characterized in that the cross-sectional dimensions of the groove are between 0.5 millimeters and 2.0 millimeters in width with a minimum depth of 0.1 millimeters.

* * * * *